US006279582B1

(12) United States Patent
Wang

(10) Patent No.: US 6,279,582 B1
(45) Date of Patent: Aug. 28, 2001

(54) HAIRBRUSH HAVING A BRUSH SEAT PROVIDED WITH SLIDABLE BRISTLES THERETO

(76) Inventor: Huo-Pia Wang, No. 9-2, Alley An-Tou, Yen-Ping Li, Chang-Hua City (TW)

( * ) Notice: Subject to any disclaimer, the term of this patent is extended or adjusted under 35 U.S.C. 154(b) by 0 days.

(21) Appl. No.: 09/475,039

(22) Filed: Dec. 30, 1999

(51) Int. Cl.[7] ..... A45D 24/00
(52) U.S. Cl. ..... 132/154; 119/632; 132/901
(58) Field of Search ..... 132/152, 153, 132/154, 156, 155, 901; 119/625, 627, 632; 15/186

(56) References Cited

U.S. PATENT DOCUMENTS 212,844 * 3/1879 Freeman ..... 15/186
1,322,268 * 11/1919 St. Clair ..... 132/153
1,702,197 * 2/1929 Cosby ..... 132/154
2,110,323 * 3/1938 Carns et al. ..... 132/152
2,138,872 * 12/1938 Marogg ..... 15/186
2,221,446 * 11/1940 Evans ..... 132/154
2,401,143 * 5/1946 Dorkin ..... 132/154
2,482,928 * 9/1949 Neff et al. ..... 119/632
3,651,532 * 3/1972 Wettburg ..... 15/186
3,855,689 * 12/1974 Schiffman ..... 132/152
4,936,259 * 6/1990 Owen et al. ..... 15/186

* cited by examiner

*Primary Examiner*—Todd E. Manahan
(74) *Attorney, Agent, or Firm*—Finnegan, Henderson, Farabow, Garrett & Dunner, L.L.P.

(57) ABSTRACT

A hairbrush includes a handle body formed with a hollow brush seat on one end. The brush seat has a bottom wall, and defines a bristle accommodating space above the bottom wall. The bottom wall is formed with a row of bristle holes therethrough. A flexible bristle retention member is disposed on the bottom wall inside the bristle accommodating space. Each of a plurality of bristles has a head portion connected to the bristle retention member, a middle portion that passes slidably through a respective one of the bristle holes, and a tip portion disposed outwardly of the bristle accommodating space.

3 Claims, 9 Drawing Sheets

HAIRBRUSH HAVING A BRUSH SEAT PROVIDED WITH SLIDABLE BRISTLES THERETO

FIELD OF THE INVENTION

The invention relates to a hairbrush, more particularly to a hairbrush which has a brush seat provided with a plurality of slidable bristles thereto.

BACKROUND OF THE INVENTION

Referring to FIGS. 1 and 2, a conventional hairbrush 10 is shown to include a handle body 13 with a brush seat 11 at one end thereof, and a plurality of bristles 12.

As illustrated, the brush seat 11 is formed with a bottom portion llB. Each of the bristles 12 has a connecting portion 12C connected securely to the bottom portion 11B of the brush seat 11, and a combing portion 12B extending away from the bottom portion 11B.

A drawback of the aforesaid conventional hairbrush arises when combing hair. Because the length of the bristles 12 is fixed, the bristles 12 that are located on two lateral sides of the hairbrush 10 can not fully reach the scalp 14 such that the user will have a feeling that his/her hair is not thoroughly brushed.

SUMMARY OF THE INVENTION

The object of this invention is to provide a hairbrush which is clear of the aforesaid drawback that generally results from the use of the conventional hairbrush.

Accordingly, the hairbrush of the present invention includes a handle body, a flexible bristle retention member, and a plurality of bristles. The handle body is formed with a hollow brush seat on one end. The brush seat has a bottom wall, and defines a bristle accommodating space above the bottom wall. The bottom wall is formed with a row of bristle holes therethrough. The bristle retention member is disposed on the bottom wall inside the bristle accommodating space. Each of the bristles has a head portion connected to the bristle retention member, a middle portion that passes slidably through a respective one of the bristle holes, and a tip portion disposed outwardly of the bristle accommodating space.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
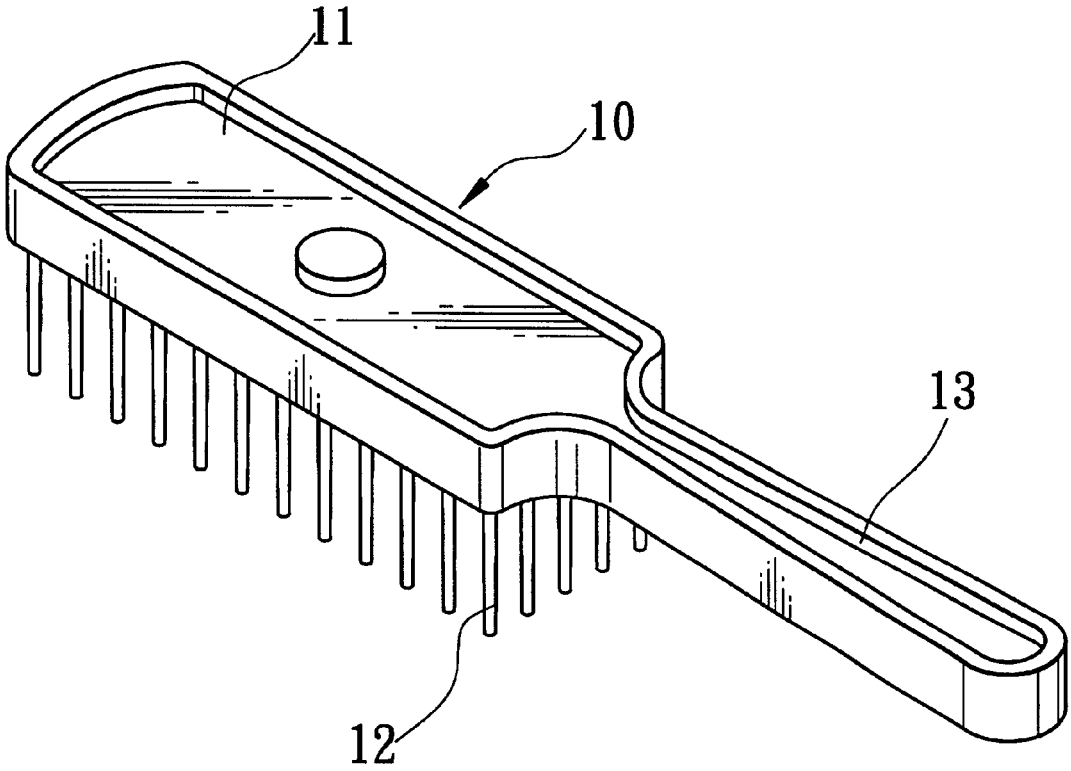
FIG. 1 PRIOR ART
FIG. 1 is a perspective view of a conventional hairbrush.
Figure 2:
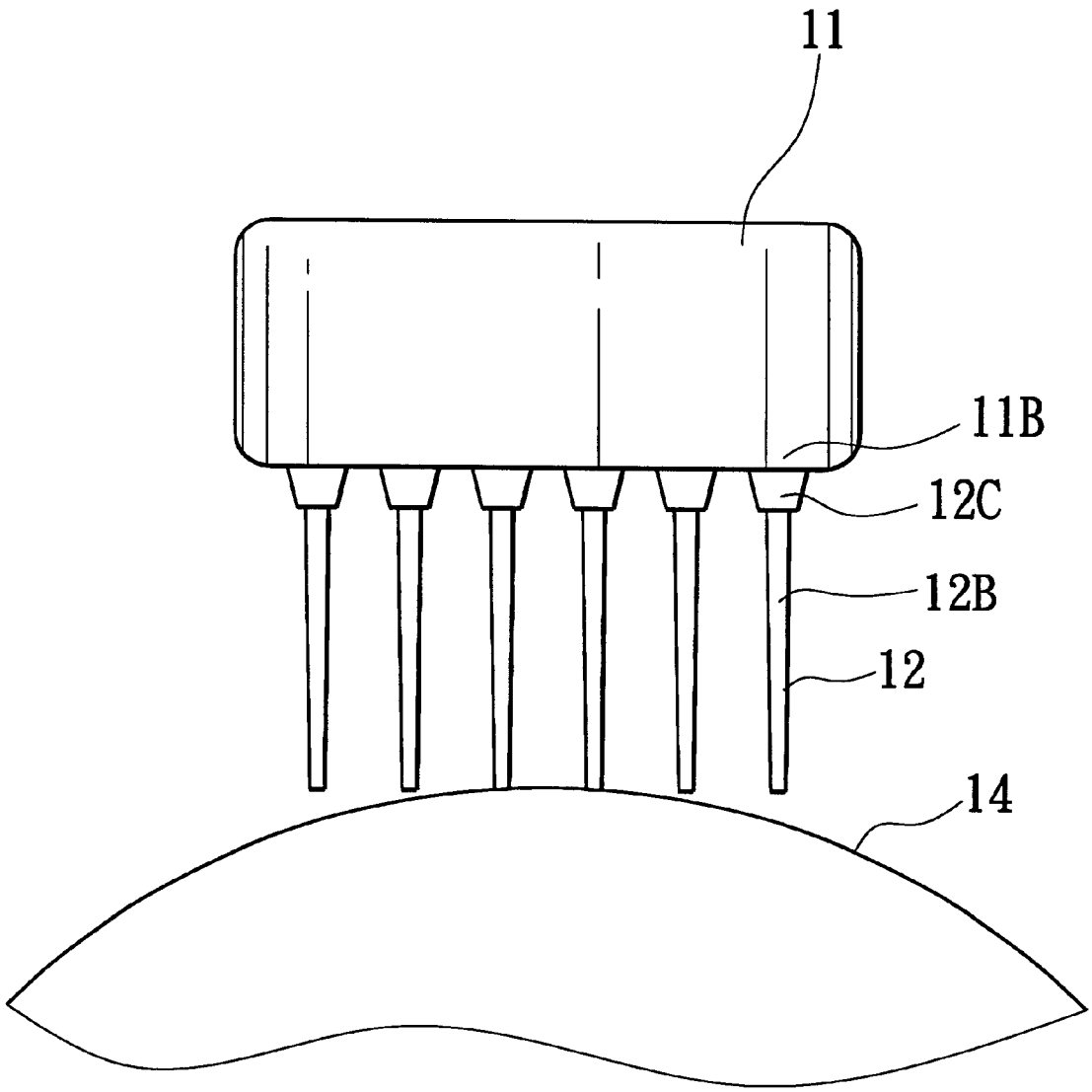
FIG. 2 PRIOR ART
FIG. 2 is a schematic view illustrating the conventional hairbrush in a state of use.
Figure 3:
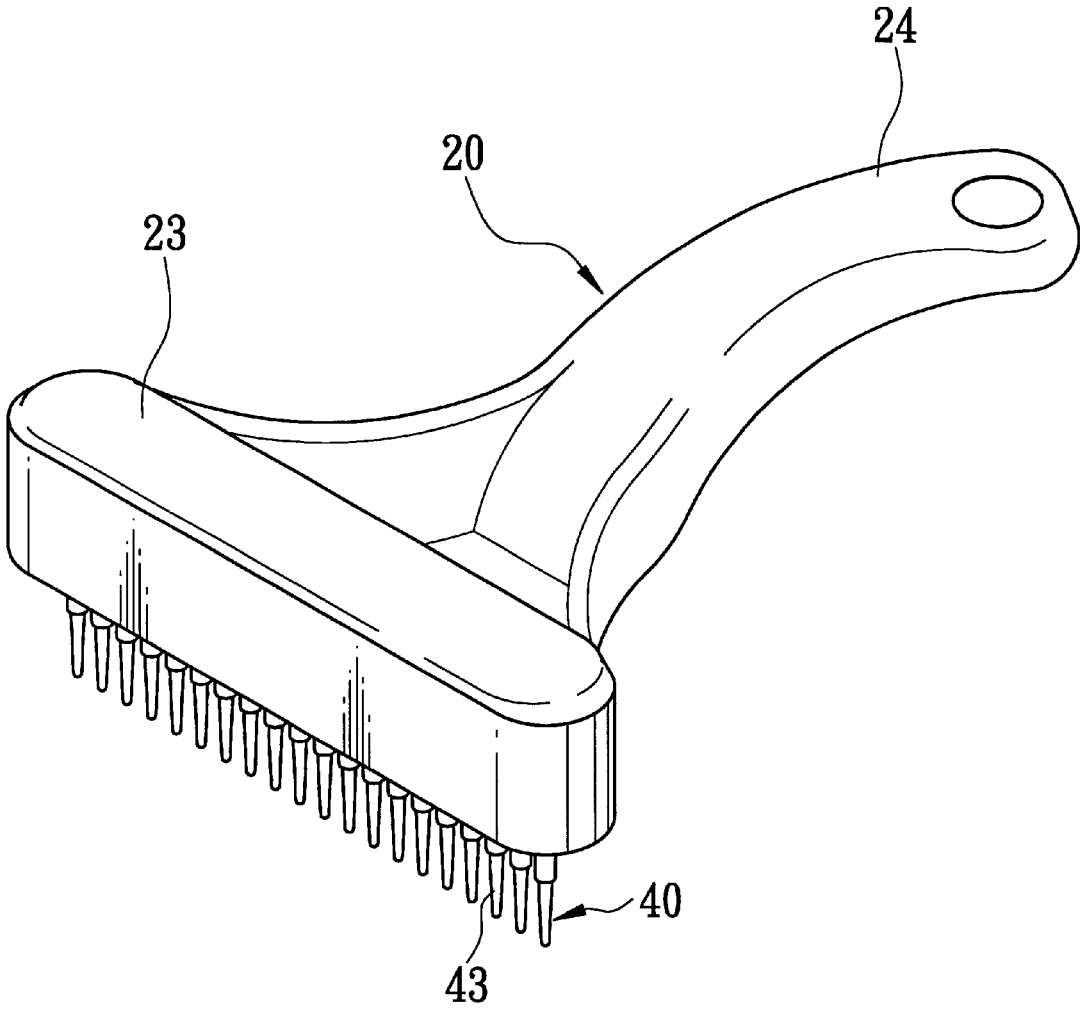
FIG. 3 is a perspective view of the first preferred embodiment of a hairbrush of the present invention.
Figure 4:
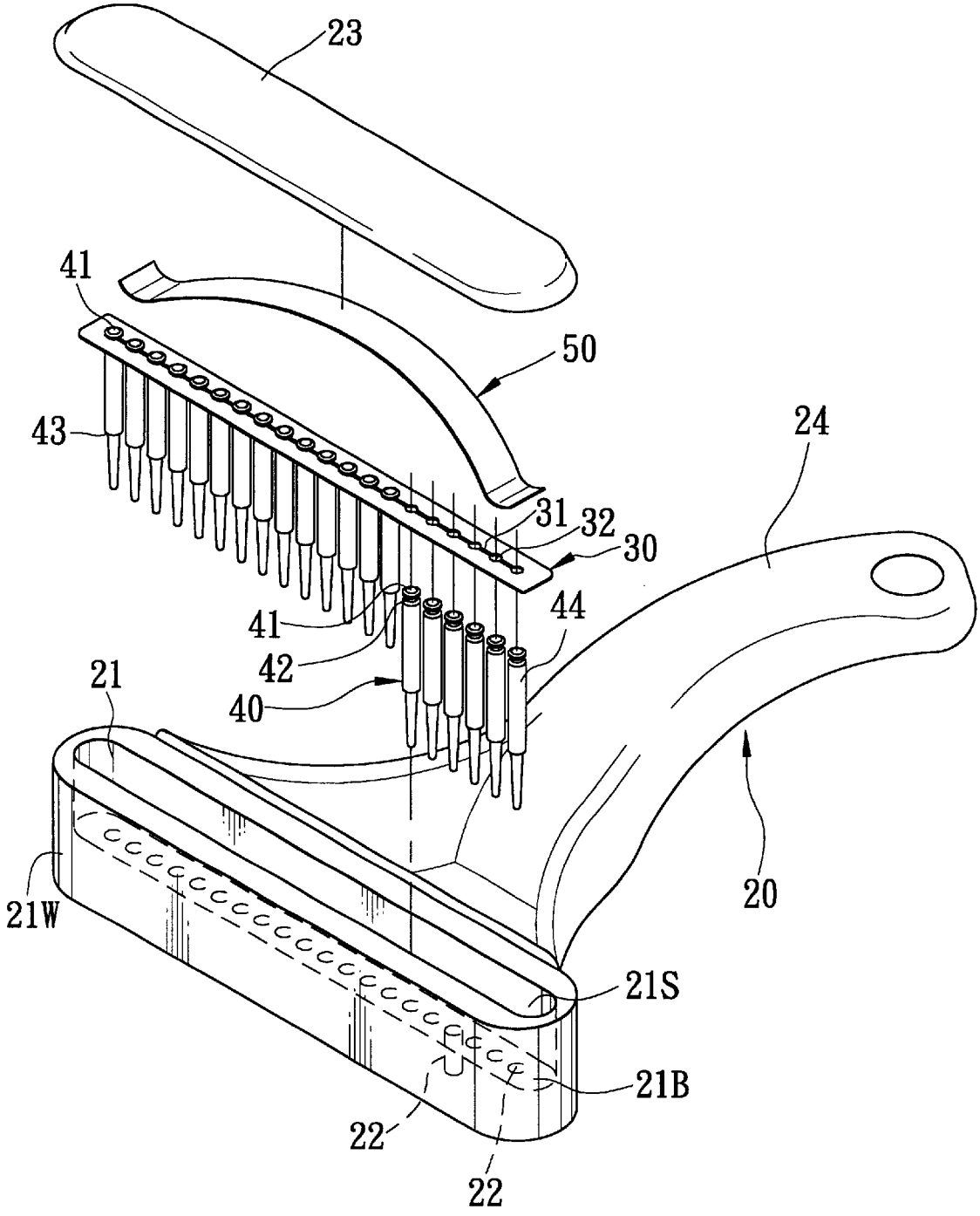
FIG. 4 is an exploded perspective view of the first preferred embodiment.
Figure 5:
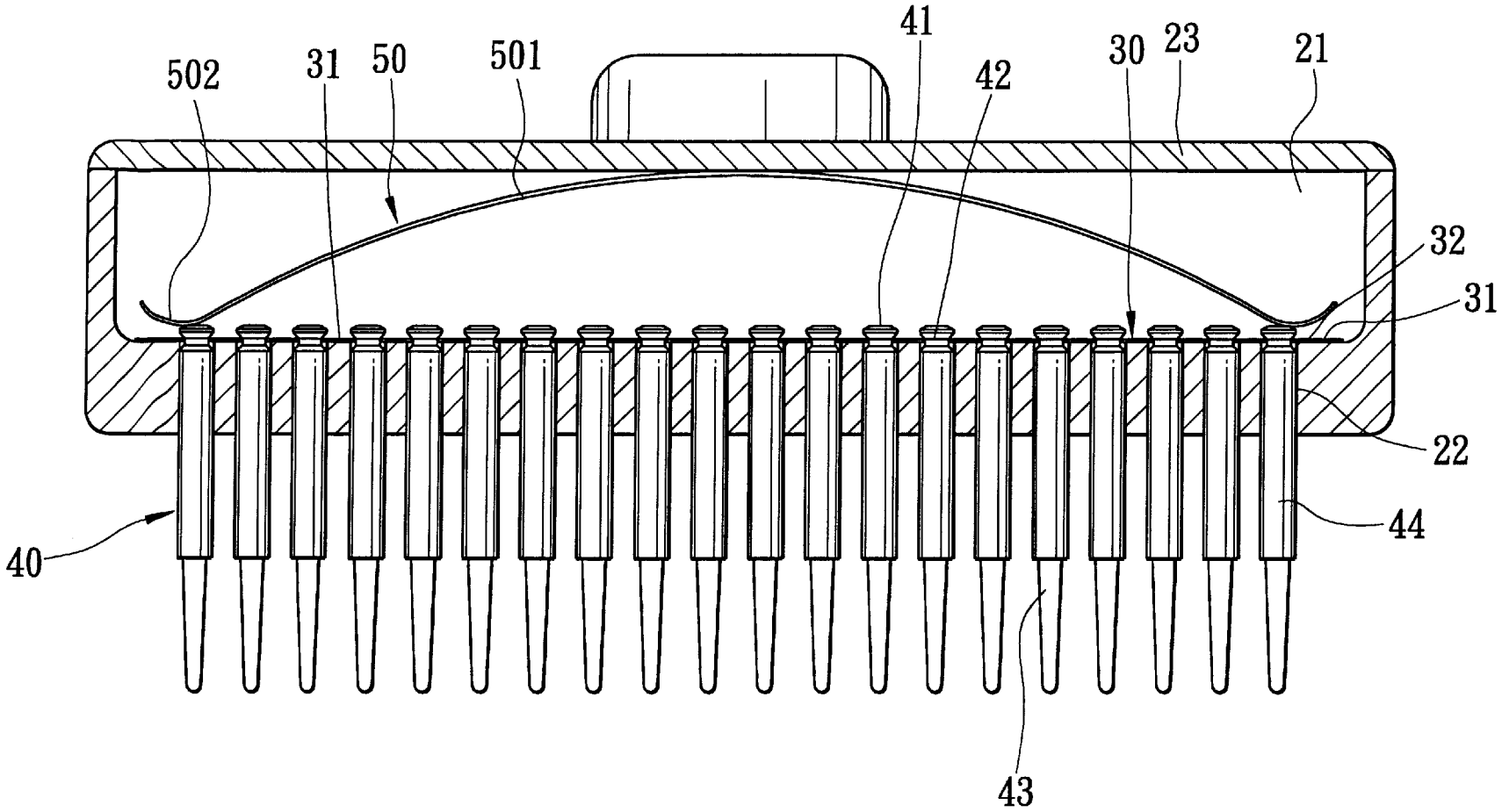
FIG. 5 is a sectional view of the first preferred embodiment.
Figure 6A:
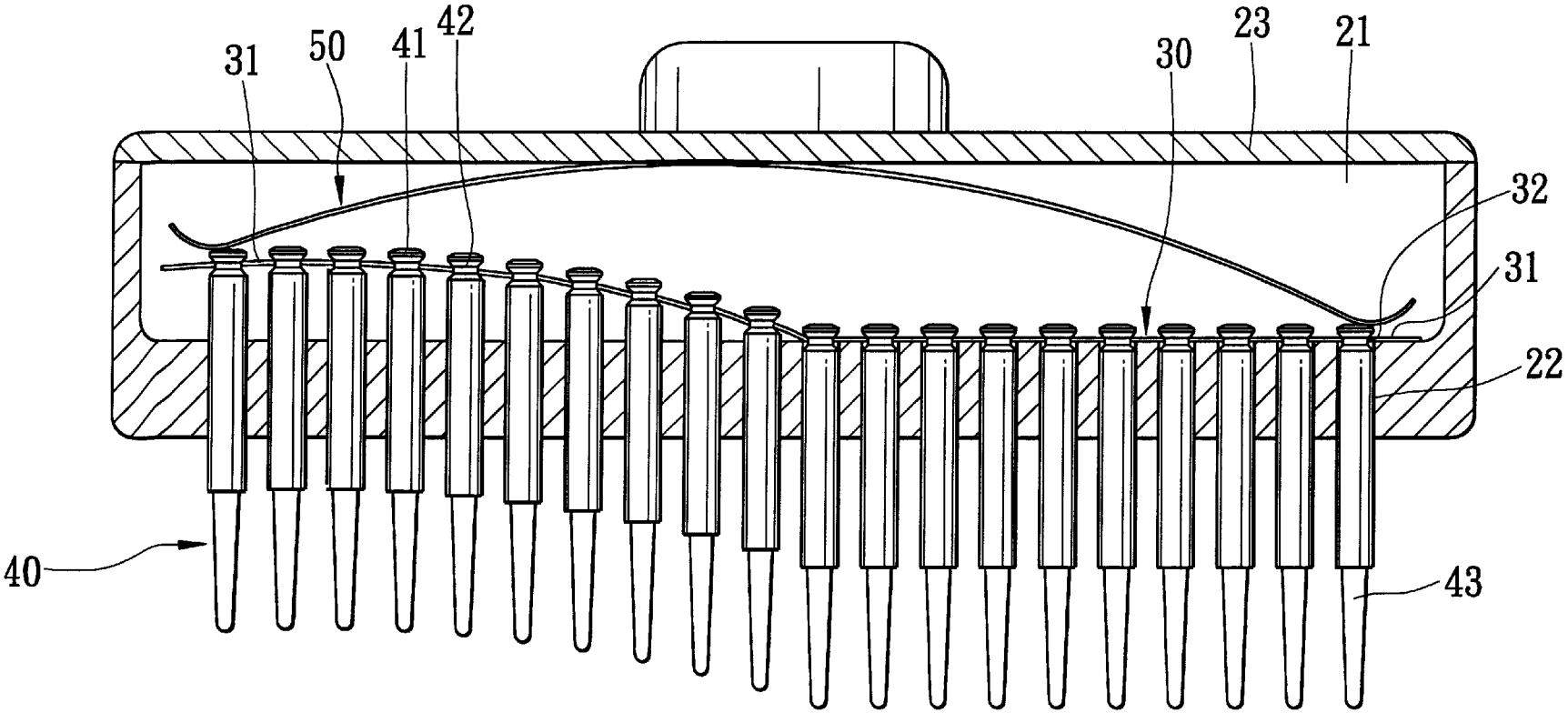
FIGS. 6(A) and 6(B) are sectional views of the first preferred embodiment in first and second conditions of use.
Figure 6B:
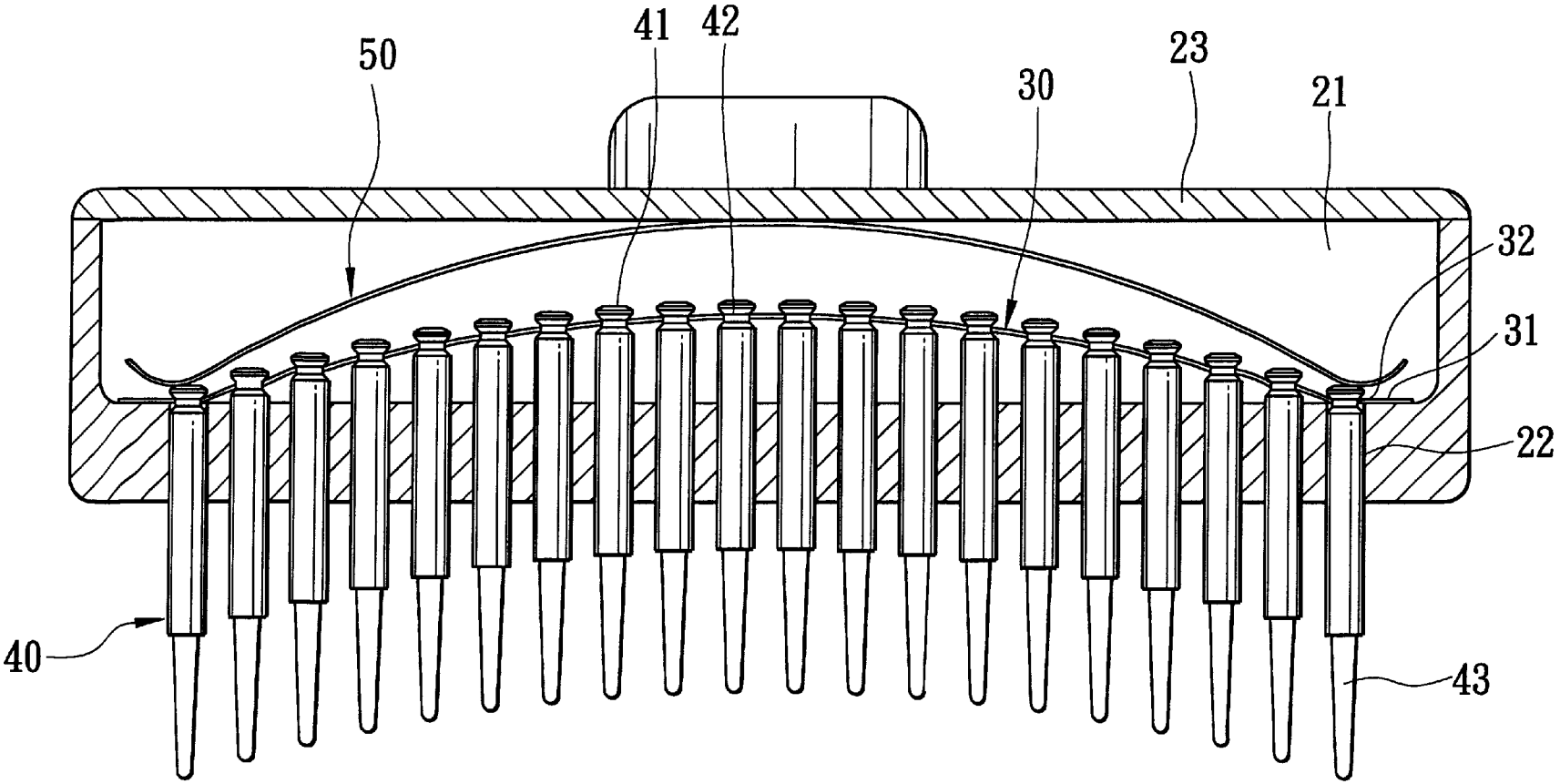

Referring to FIGS. 3, 4 and 5, the first preferred embodiment of a hairbrush 20 of the present invention is shown to include a handle body 24, a bristle retention member 30, and a plurality of bristles 40.

As illustrated, the handle body 24 is formed with a hollow brush seat 21 on one end. The brush seat 21 has a bottom wall (21B), and defines a bristle accommodating space (21S) above the bottom wall (21B). The bottom wall (21B) is formed with a row of bristle holes 22 therethrough.

The bristle retention member 30 is formed as an elongated flexible thin plate. The retention member 30 is disposed on the bottom wall (21B) inside the bristle accommodating space (21S).

Each of the bristles 40 has a head portion 41 connected to the bristle retention member 30, a middle portion 44 that passes slidably through a respective one of the bristle holes 22, and a tip portion 43 disposed outwardly of the bristle accommodating space (21S).

The bristle retention member 30 is formed with a longitudinal slit 31, and a plurality of bristle retaining holes (32) disposed along the slit 31 and aligned respectively with the bristle holes 22 in the bottom wall (21B) Each of the bristle retaining holes 32 has a hole-confining periphery. The head portion 41 of each of the bristles 40 is formed with a retaining groove 42 for engaging the bristle retention member 30 at the hole-confining periphery of a respective one of the bristle retaining holes 32.

The brush seat 21 further has a looped surrounding wall (21W) (see FIG. 4) that extends upwardly from a periphery of the bottom wall (21B) so as to confine the bristle accommodating space (21S) therewith, and a top cover 23 mounted on an upper end of the surrounding wall (21W) opposite to the bottom wall (21B) via known high frequency sealing techniques so as to close the bristle accommodating space (21S).

Figure 7:
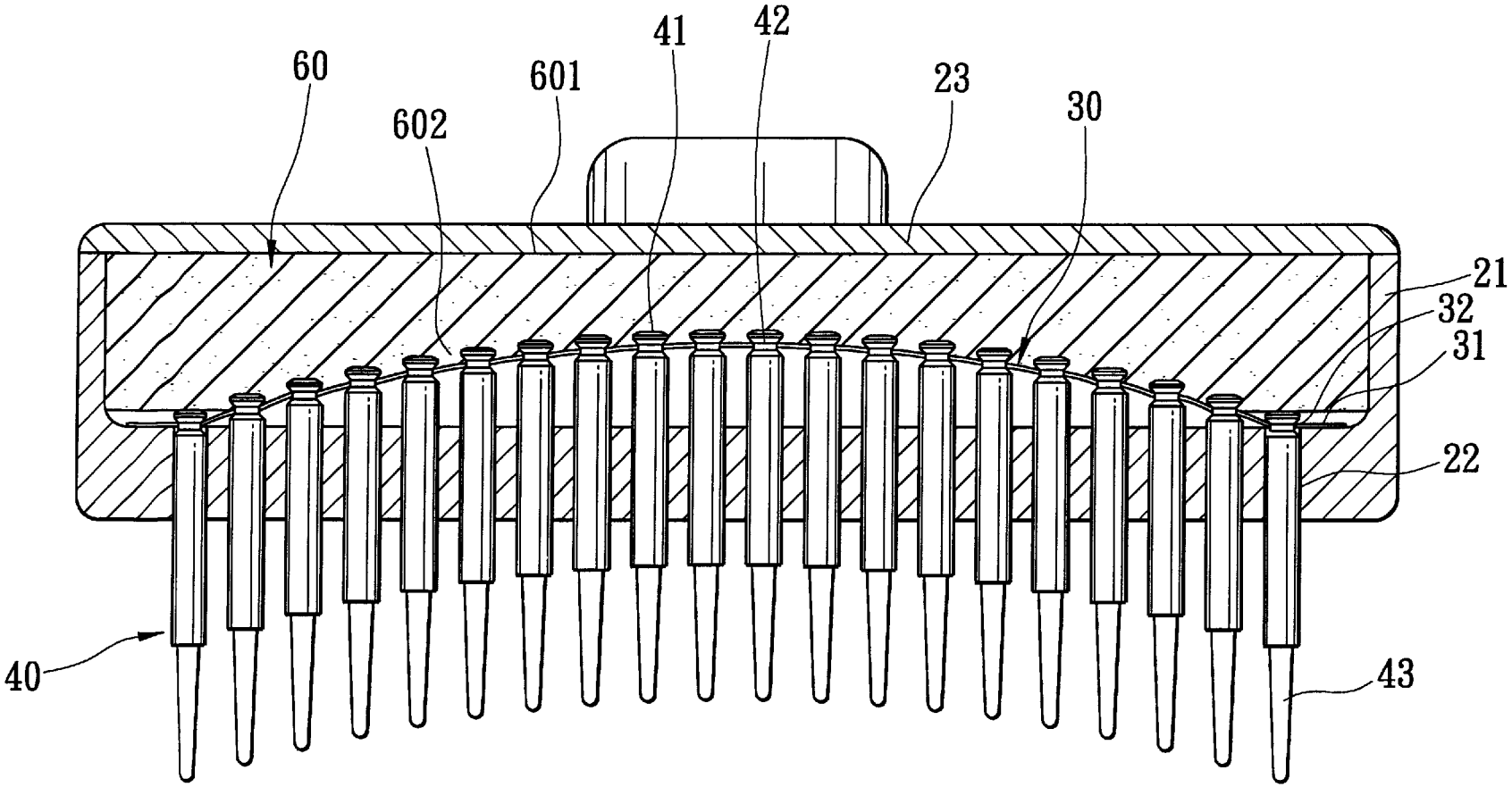
FIG. 7 is a sectional view of the second preferred embodiment of the present invention when in use.

A biasing unit 50 is disposed in the bristle accommodating space (21S) for biasing the bristles 40 to extend outwardly of the bristle accommodating space (21S). The biasing unit 50 includes a curved leaf spring having a convex intermediate portion 501 that abuts against the top cover 23, and two distal end portions 502 that press the bristle retention member 30 against the bottom wall (21B). Alternatively, in another preferred embodiment, the biasing unit can be a resilient block 60 (see FIG. 7), such as rubber, which has an upper portion 601 that abuts against the top cover 23, and a lower portion 602 that presses the bristle retention member 30 against the bottom wall (21B). The resilient block 60 can also be made from a sponge material.

Figure 8:
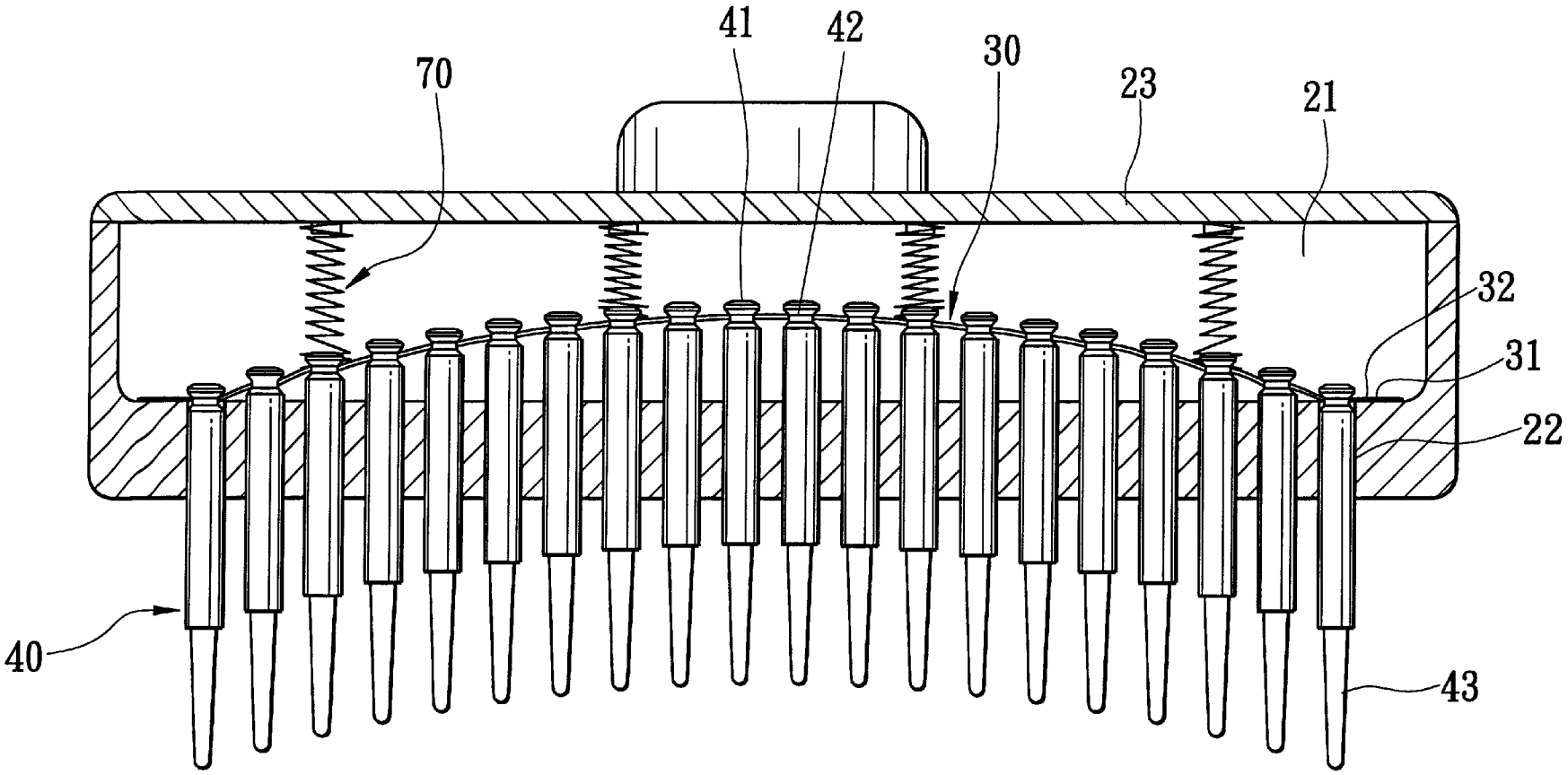
FIG. 8 is a sectional view of the third preferred embodiment of the present invention when in use.

In a further preferred embodiment, the biasing unit can be a plurality of coiled springs 70 (see FIG. 8), each of which has an upper end that abuts against the top cover 23, and a lower end that presses the bristle retention member 30 against the bottom wall 21S.

As best illustrated in FIGS. 6(A), 6(B), 7 and 8, since the bristles 40 are slidable relative to the bottom wall 21B of the brush seat 21, and since the bristle retention member 30 is flexible, the tip portions 43 of the bristles 40 can conform with the outline of the scalp so that hair can be thoroughly brushed.

With this invention thus explained, it is apparent that numerous modifications and variations can be made without departing from the scope and spirit of this invention. It is therefore intended that this invention be limited only as indicated in the appended claims.

I claim:

1. A hairbrush comprising:

a handle body formed with a hollow brush seat on one end, said brush seat having a bottom wall and defining a bristle accommodating space above said bottom wall, said bottom wall being formed with a row of bristle holes therethrough;

a flexible bristle retention member disposed on said bottom wall inside said bristle accommodating space; and a plurality of bristles, each of which has a head portion connected to said bristle retention member, a middle portion passing slidably through a respective one of said bristle holes, and a tip portion disposed outwardly of said bristle accommodating space, wherein said bristle retention member is formed as a flexible plate having a longitudinal slit, and a plurality of bristle retaining holes are disposed along said slit and aligned respectively with said bristle holes of said bottom wall.

2. The hairbrush as defined in claim 1, wherein each of said bristle retaining holes has a hole-confining periphery, and said head portion of each of said bristles is formed with a retaining groove for engaging said bristle retention member at said hole-confining periphery of a respective one of said bristle retaining holes.

3. A hairbrush comprising:

a handle body formed with a hollow brush seat on one end, said brush seat having a bottom wall and defining a bristle accommodating space above said bottom wall, said bottom wall being formed with a row of bristle holes therethrough;

a flexible bristle retention member disposed on said bottom wall inside said bristle accommodating space; and a plurality of bristles, each of which has a head portion connected to said bristle retention member, a middle portion passing slidably through a respective one of said bristle holes, and a tip portion disposed outwardly of said bristle accommodating space, wherein said brush seat further has a looped surrounding wall that extends upwardly from a periphery of said bottom walls so as to confine said bristle accommodating space therewith, and a top cover mounted on an upper end of said surrounding wall opposite to said bottom wall to close said bristle accommodating space, said hairbrush further comprising a biasing unit disposed in said bristle accommodating space for biasing said bristles to extend outwardly of said bristle accommodating space, wherein said biasing unit includes a curved leaf spring having a convex intermediate portion that abuts against said top cover, and two distal end portions that pressaid bristle retention member against said bottom wall.

* * * * *